US007120576B2

(12) United States Patent
Gao

(10) Patent No.: US 7,120,576 B2
(45) **Date of Patent: *Oct. 10, 2006**

(54) LOW-COMPLEXITY MUSIC DETECTION ALGORITHM AND SYSTEM

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 118 days.

This patent is subject to a terminal disclaimer.

(21) Appl. No.: 10/981,022

(22) Filed: Nov. 4, 2004

(65) Prior Publication Data

US 2006/0015333 A1 Jan. 19, 2006

Related U.S. Application Data

(60) Provisional application No. 60/588,445, filed on Jul. 16, 2004.

(51) Int. Cl.
*G10L 11/06* (2006.01)

(52) U.S. Cl. ..... 704/208; 704/214

(58) Field of Classification Search ..... None
See application file for complete search history.

(56) References Cited

U.S. PATENT DOCUMENTS

| | | | | |
|---|---|---|---|---|
| 6,240,386 | B1 * | 5/2001 | Thyssen et al. | 704/220 |
| 6,570,991 | B1 * | 5/2003 | Scheirer et al. | 381/110 |
| 6,633,841 | B1 * | 10/2003 | Thyssen et al. | 704/233 |
| 2002/0161576 | A1 * | 10/2002 | Benyassine et al. | 704/229 |

* cited by examiner

*Primary Examiner*—Abul K. Azad
(74) *Attorney, Agent, or Firm*—Farjami & Farjami LLP

(57) ABSTRACT

A method for detecting music in a speech signal having a plurality of frames. The method comprises defining a music threshold value for a first parameter extracted from a frame of the speech signal, defining a background noise threshold value for the first parameter, and defining an unsure threshold value for the first parameter. The unsure threshold value falls between the music threshold value and the background noise threshold value. If the first parameter falls between the music threshold value and the background noise threshold value, the speech signal is classified as music or background noise based on analyzing a plurality of first parameters extracted from the plurality of frames.

36 Claims, 8 Drawing Sheets

LOW-COMPLEXITY MUSIC DETECTION ALGORITHM AND SYSTEM

CROSS-REFERENCE TO RELATED APPLICATION

The present application is based on and claims priority to U.S. Provisional Application Ser. No. 60/588,445, filed Jul. 16, 2004, which is hereby incorporated by reference.

APPENDIX

An appendix is included comprising an example computer program listing according to one embodiment of the present invention.

BACKGROUND OF THE INVENTION

1. Field of the Invention

The present invention relates generally to music detection. More particularly, the present invention relates to music detection software for facilitating the detection of substantially music-like signals.

2. Background Art

In various speech coding systems it is useful to be able to detect the presence or absence of music, in addition to detecting voice and background noise. For example a music signal can be coded in a manner different from voice or background noise signals.

Speech coding schemes of the past and present often operate on data transmission media having limited available bandwidth. These conventional systems commonly seek to minimize data transmission while simultaneously maintaining a high perceptual quality of speech signals. Conventional speech coding methods do not address the problems associated with efficiently generating a high perceptual quality for speech signals having a substantially music-like signal. In other words, existing music detection algorithms are typically either overly complex and consume an undesirable amount of processing power, or are poor in ability to accurately classify music signals.

Further, conventional speech coding systems often employ voice activity detectors ("VADs") that examine a speech signal and differentiate between voice and background noise. However, conventional VADs often cannot differentiate music from background noise. As is known in the art, background noise signals are typically fairly stable as compared to voice signals. The frequency spectrum of voice signals (or unvoiced signals) changes rapidly. In contrast to voice signals, background noise signals exhibit the same or similar frequency for a relatively long period of time, and therefore exhibit heightened stability. Therefore, in conventional approaches, differentiating between voice signals and background noise signals is fairly simple and is based on signal stability. Unfortunately, music signals are also typically relatively stable for a number of frames (e.g. several hundred frames). For this reason, conventional VADs often fail to differentiate between background noise signals and music signals, and exhibit rapidly fluctuating outputs for music signals.

If a conventional VAD considers a speech signal not to represent voice, the conventional system will often simply classify the speech signal as background noise and employ low bit rate encoding. However, the speech signal may in fact comprise music and not background noise. Employing low bit rate encoding to encode a music signal can result in a low perceptual quality of the speech signal, or in this case, poor quality music.

Although previous attempts have been made to detect music and differentiate music from voice and background noise, these attempts have often proven to be inefficient, requiring complex algorithms and consuming a vast amount of processing resources and time.

Thus, it is seen that there is need in the art for an improved algorithm and system for differentiating music from background noise with high accuracy but relatively low-complexity to perform music detection using minimal processing time and resources.

SUMMARY OF THE INVENTION

The present invention is directed to a low-complexity music detection algorithm and system. The invention overcomes the need in the art for need in the art for an improved algorithm and system for differentiating music from background noise with high accuracy but relatively low-complexity to perform music detection using minimal processing time and resources.

According to one embodiment of the invention, a method is contemplated for detecting music in a speech signal having a plurality of frames. The method comprises defining a music threshold value for a first parameter extracted from a frame of said speech signal, defining a background noise threshold value for the first parameter, and defining an unsure threshold value for the first parameter. The unsure threshold value falls between the music threshold value and the background noise threshold value. If the first parameter does not fall between the music threshold value and the background noise threshold value, the speech signal is classified as music if the first parameter is in closer range of the music threshold value than the unsure threshold value, and the speech signal is classified as background noise if the first parameter is in closer range of the background noise threshold value than the unsure threshold value. If the first parameter falls between the music threshold value and the background noise threshold value, the speech signal is classified as music or background noise based on analyzing a plurality of first parameters extracted from the plurality of frames.

According to another embodiment of the invention, a system is contemplated for detecting music in a speech signal having a plurality of frames. The system comprises a module for defining a music threshold value for a first parameter extracted from a frame of the speech signal, a module for defining a background noise threshold value for the first parameter, and a module for defining an unsure threshold value for the first parameter. The unsure threshold value falls between the music threshold value and the background noise threshold value. The system further comprises a module for classifying the speech signal as music if the first parameter is in closer range of the music threshold value than the unsure threshold value, if the first parameter does not fall between the music threshold value and the background noise threshold value. A module is also provided for classifying the speech signal as background noise if the first parameter is in closer range of the background noise threshold value than the unsure threshold value, if the first parameter does not fall between the music threshold value and the background noise threshold value. The system also comprises a module for classifying the speech signal as music or background noise based on analyzing a plurality of first parameters extracted from the plurality of frames, if the first parameter falls between the music threshold value and the background noise threshold value.

According to another embodiment, a computer readable medium includes a computer software program executable by a processor for implementing a method of detecting music in a speech signal having a plurality of frames. The computer software program comprises code for defining a music threshold value for a first parameter extracted from a frame of the speech signal, code for defining a background noise threshold value for the first parameter, and code for defining an unsure threshold value for the first parameter. The unsure threshold value falls between the music threshold value and the background noise threshold value. The computer software program further comprises code for classifying the speech signal as music if the first parameter is in closer range of the music threshold value than the unsure threshold value, if the first parameter does not fall between the music threshold value and the background noise threshold value. The computer software program also comprises code for classifying the speech signal as background noise if the first parameter is in closer range of the background noise threshold value than the unsure threshold value, if the first parameter does not fall between said music threshold value and the background noise threshold value. Code is also provided for classifying the speech signal as music or background noise based on analyzing a plurality of first parameters extracted from the plurality of frames, if the first parameter falls between the music threshold value and the background noise threshold value.

Other features and advantages of the present invention will become more readily apparent to those of ordinary skill in the art after reviewing the following detailed description and accompanying drawings.

DETAILED DESCRIPTION OF THE INVENTION

Figure 1:
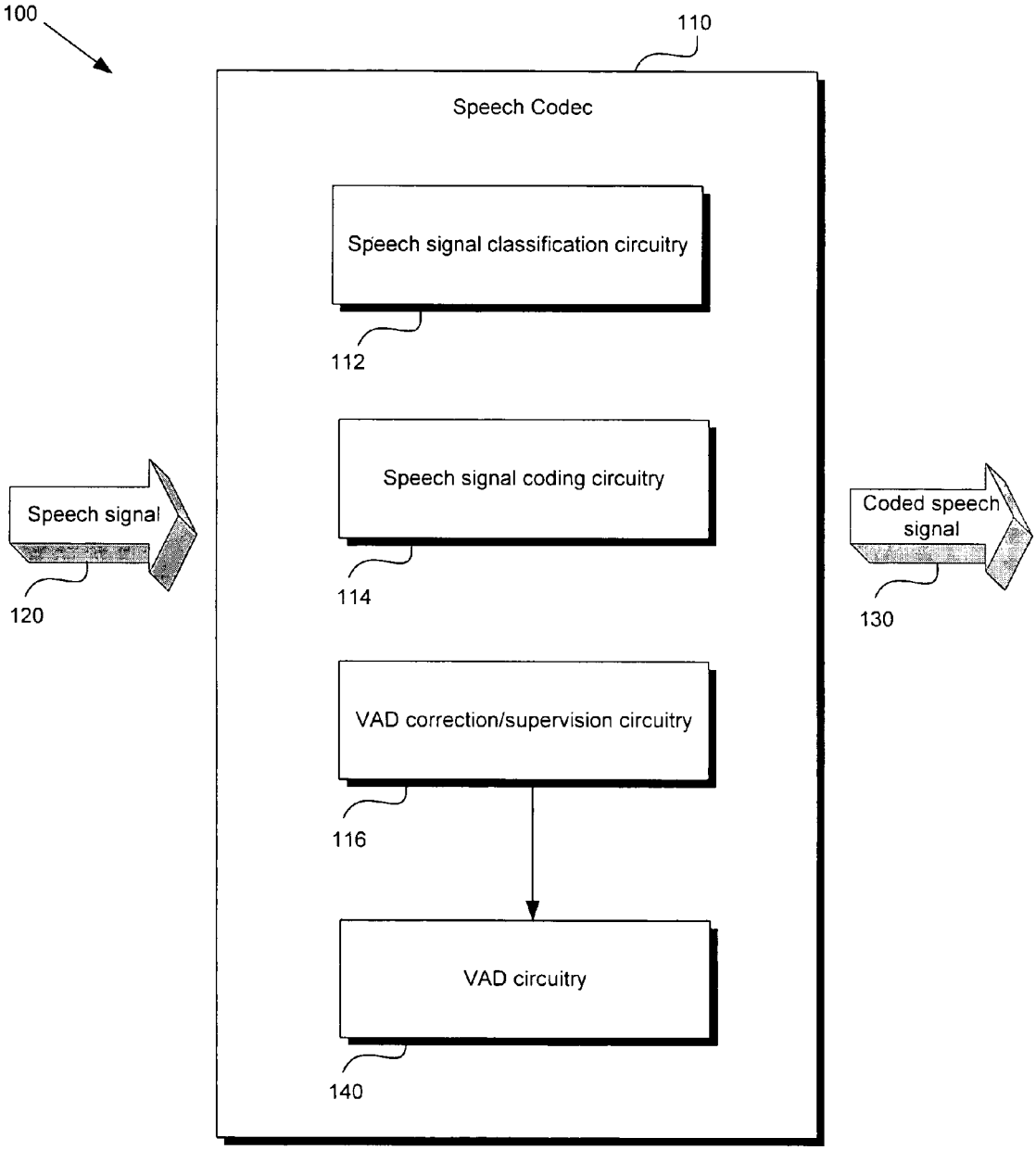
FIG. 1 is a system diagram illustrating a speech coding system, according to one embodiment of the invention.

The present invention is directed to a low-complexity music detection algorithm and system. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

FIG. 1 is a system diagram illustrating an embodiment of a speech coding system 100 built in accordance with an embodiment of the present invention. Speech coding system 100 contains speech codec 110. Speech codec 110 receives speech signal 120 and generates coded speech signal 130. To perform the generation of coded speech signal 130 from speech signal 120, speech codec 110 employs, among other things, speech signal classification circuitry 112, speech signal coding circuitry 114, VAD (voice activity detection) correction/supervision circuitry 116, and VAD circuitry 140. Speech signal classification circuitry 112 identifies characteristics in speech signal 120.

VAD correction/supervision circuitry 116 is used, in certain embodiments according to the present invention, to ensure the correct detection of the substantially music like signal within speech signal 120. VAD correction/supervision circuitry 116 is operable to provide direction to VAD circuitry 140 in making any VAD decisions on the coding of speech signal 120. Subsequently, speech signal coding circuitry 114 performs the speech signal coding to generate coded speech signal 130. Speech signal coding circuitry 114 ensures an improved perceptual quality in coded speech signal 130 during discontinued transmission (DTX) operation, particularly when there is a presence of the substantially music-like signal in speech signal 120.

Speech signal 120 and coded speech signal 130, within the scope of the invention, include a broader range of signals than simply those containing only speech. For example, if desired in certain embodiments according to the present invention, speech signal 120 is a signal having multiple components including a substantially speech-like component. For instance, a portion of speech signal 120 might be dedicated substantially to control of speech signal 120 itself wherein the portion illustrated by speech signal 120 is in fact the substantially speech signal 120 itself. In other words, speech signal 120 and coded speech signal 130 are intended to illustrate the embodiments of the invention that include a speech signal, yet other signals, including those containing a portion of a speech signal, are included within the scope and spirit of the invention. Alternatively, speech signal 120 and coded speech signal 130 would include an audio signal component in other embodiments according to the present invention.

Figure 2:
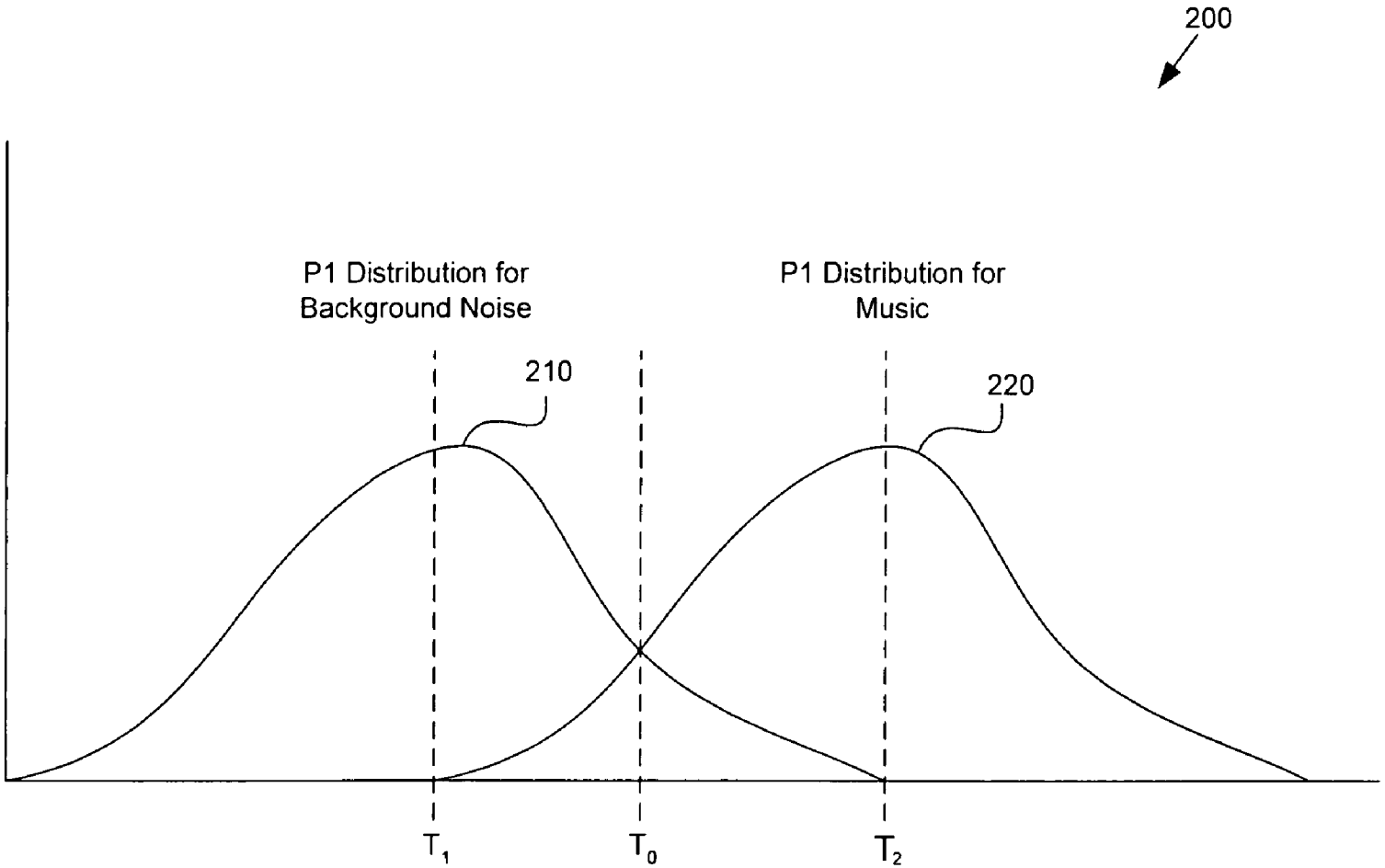
FIG. 2 is a distribution graph of a speech coding parameter for background noise and music, according to one embodiment of the invention.

FIG. 2 illustrates distribution graph 200 of a speech coding parameter for background noise and music, according to one embodiment of the invention. Background noise distribution 210 and music distribution 220 are shown for example samples of music and noise, respectively, taken over a period of time. The horizontal axis represents the value of an example speech coding parameter $P_1$, and the vertical axis represents the probability that the parameter will have the respective value on the horizontal axis. The speech coding parameter $P_1$ can be calculated by a speech coder, such as a G.729 coder. Speech coding parameter $P_1$ can represent various speech coding parameters, including pitch correlation ($R_p$), linear prediction coding (LPC) gain, and the like. In one embodiment, a single speech coding parameter $P_1$ can be used for differentiating between music and background noise, as discussed below. However, in other embodiments, more than one speech coding parameter may be used, which can represent multi-dimensional vectors, and which are discussed herein.

Referring to FIG. 2, threshold value $T_1$ represents the value of $P_1$ to the left of which the speech frame being processed is deemed to be background noise. Likewise, threshold value $T_2$ represents the value of $P_1$ to the right of which the speech frame being processed is deemed to be music. Threshold value $T_0$ represents the value of $P_1$ at the intersection of background noise distribution 210 and music distribution 220. In the example shown, music distribution 220 and background noise distribution 210 can represent the distribution of the pitch correlation ($R_p$) for music frames and background noise frames, respectively. It should be noted that for other speech coding parameters, background noise distribution 210 might be to the right of music distribution 220 depending upon what parameter $P_1$ represents.

Since in one embodiment, speech coding parameter $P_1$, such as the pitch correlation ($R_p$), has already been calculated by the speech coder, such as the G.729 coder, the present scheme substantially reduces complexity and time by receiving speech coding parameter $P_1$ from the speech coder and using the same to differentiate between background noise and music in a VAD module, such as VAD circuitry 140 or a VAD software module, for example.

Embodiments according to the present invention can be implemented as a software upgrade to a VAD module (such as VAD circuitry 140, for example), wherein the software upgrade includes additional functionality to the functionality in the VAD module, etc. The software upgrade can determine if a given sample of the speech signal should be classified as music or background noise, and advantageously uses one or more speech coding parameters (e.g. $P_1$) already calculated by speech signal coding circuitry 114. Whether the speech signal is classified as music or background noise will determine whether the signal is to be encoded with a high bit-rate coder or a low bit-rate coder. For example, if the speech signal is determined to be music, encoding with a high bit rate encoder might be preferable.

In one embodiment, the present invention may be implemented to override the output of the VAD if the VAD's output indicates background noise detection, but the software upgrade of the present invention determines that the speech signal is a music signal and that a high bit-rate coder should be utilized, as described in U.S. Pat. No. 6,633,841, entitled "Voice Activity Detection Speech Coding to Accommodate Music Signals," issued Oct. 14, 2003, which is hereby incorporated by reference.

In one embodiment, for a given speech frame under examination, if $P_1$ is less than $T_1$ (or in closer range of $T_1$ than to $T_0$) then $P_1$ is indicative of background noise. If $P_1$ is greater than $T_2$ (or in closer range of $T_2$ than $T_0$) then $P_1$ is indicative of music. However, if $P_1$ falls in the range between $T_1$ *and* $T_2$ then additional computation is required to determine whether $P_1$ is indicative of background noise or music. The flowchart of FIG. 3 illustrates one example approach for determining whether the speech signal is music or background noise if $P_1$ falls in the range between $T_1$ and $T_2$.

It should be noted that certain details and features have been left out of flowchart 300 that are apparent to a person of ordinary skill in the art. For example, a step may consist of one or more substeps or may involve specialized equipment, as is known in the art. While steps 302 through 322 indicated in flowchart 300 are sufficient to describe one embodiment of the present invention, other embodiments of the invention may use steps different from those shown in flowchart 300.

Figure 3:
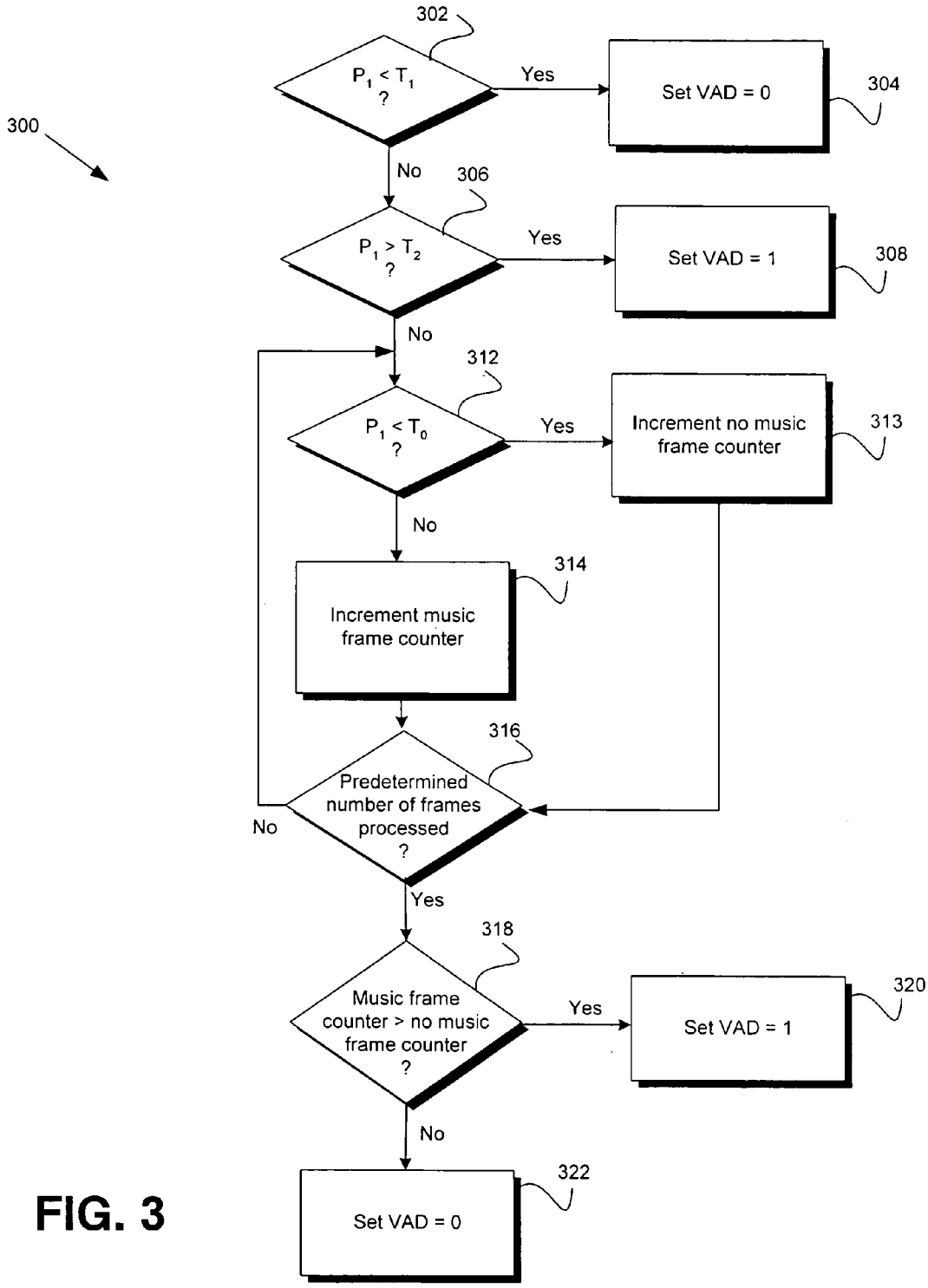
FIG. 3 illustrates a method of differentiating background noise from music using one parameter, according to one embodiment of the invention.

In one embodiment, according to FIG. 3, the process begins by examining the value of speech coding parameter $P_1$, such as pitch correlation, for a given speech frame. At the outset, the VAD may be set to a default value to indicate music or speech (as opposed to background noise, for example), such that a high bit-rate coder is utilized to code the frames. In this way, even though more bandwidth is used to code the frame, the coding system favors quality in the event that the speech signal is in fact a music signal. As shown in FIG. 3, at step 302, speech coding parameter $P_1$ is received from the speech coder and if it is less than $T_1$ then the frame is classified as background noise and the VAD output is set to zero in step 304 to indicate the same. Otherwise, the process moves to step 306 and if $P_2$ is greater than $T_2$ then the frame is classified as music and at step 308 the VAD is set to one to indicate the same. However, if speech coding parameter $P_1$ falls in between $T_1$ and $T_2$, then the process moves to step 312 for additional calculations for a predetermined number of frames, such as 100 to 200 frames for example.

At step 312, if $P_1$ is less than $T_0$ then the no music frame counter (cnt_nomus) is incremented at step 313. If $P_1$ is not less than $T_0$ at step 312 then the process proceeds to step 314. Otherwise, if $P_1$ is greater than $T_0$ then the music frame counter (cnt_mus) is incremented at step 314.

At step 316, a check is made to determine if the predetermined number of speech frames have been processed. If there is another speech frame to be examined, the process loops back to step 312. However, if the predetermined number of speech frames have been processed the process proceeds to step 318.

At step 318, the value of the music frame counter is compared to the value of the no music frame counter. If the music frame counter is greater than the no music frame counter (or in one embodiment, it is greater than the no music frame counter by a threshold value W), then the process proceeds to step 320, where the frame is classified as music and the VAD is set to one to indicate the same. Otherwise, the process proceeds to step 322, where the frame is classified as background noise and the VAD is set to zero to indicate the same.

In one embodiment, the VAD may have more than two output values. For example, in one embodiment, VAD may be set to "zero" to indicate background noise, "one" to indicate voice, and "two" to indicate music. In such event, a medium bit-rate coder may be used to code voice frames and a high bit-rate coder may be used to code music frames. In the embodiment of FIG. 3, if the music frame counter is within W of the no music frame counter, then VAD may be set to "one" rather than "two", so that a medium bit rate coder is used. In another embodiment, instead of using a medium bit-rate coder, further calculations are performed to further differentiate between background noise distribution 210 and music distribution 220.

In one embodiment, after the speech signal is classified as music and the speech frames are being coded accordingly, if a non-music speech frame is detected for a given period of time (or an extension period), such as a time period for processing 30 frames, the detection system continues to indicate that a music signal is being detected until it is confirmed that the music signal has ended. This technique can help to avoid glitches in coding.

Figure 4:
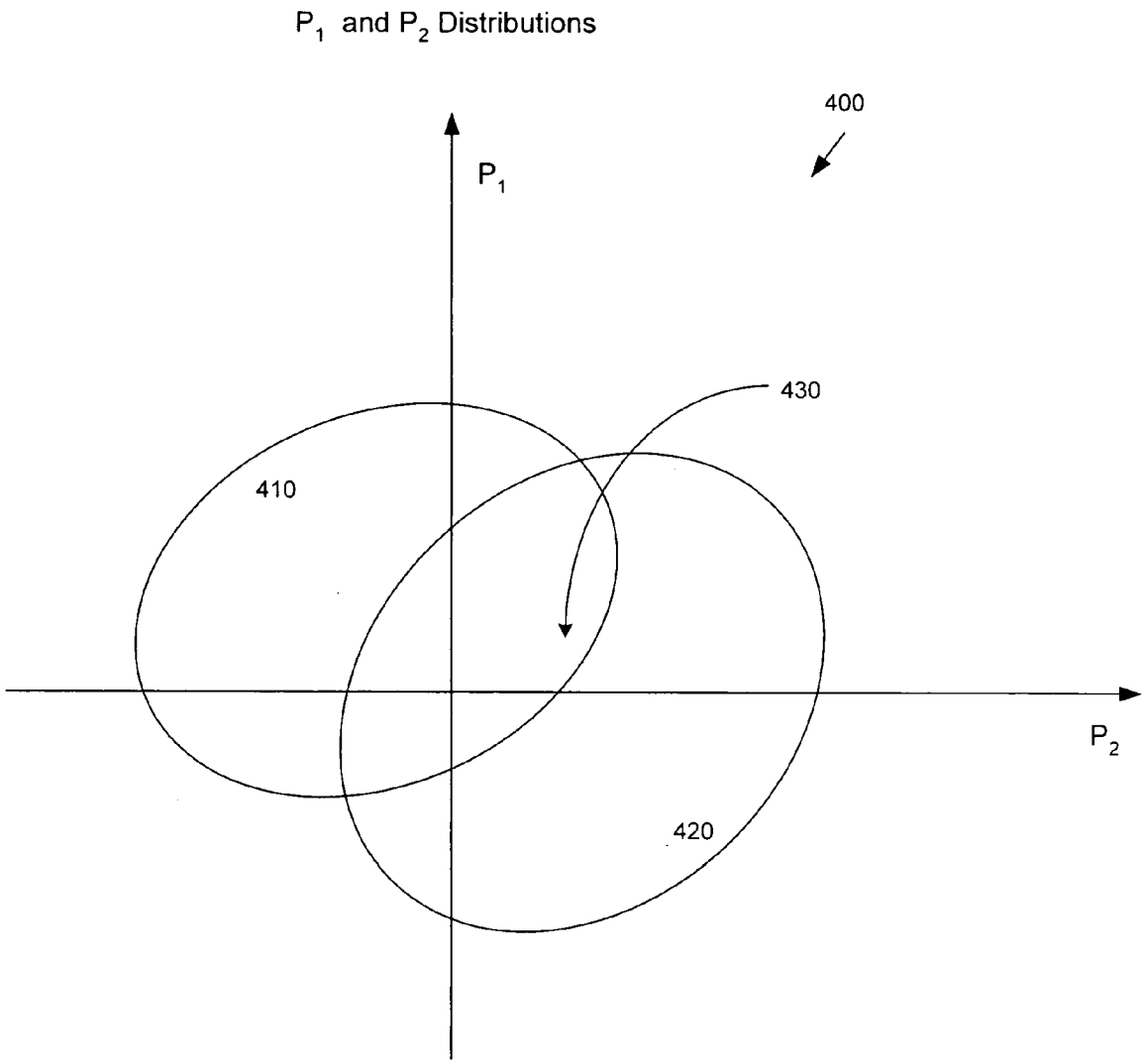
FIG. 4 is a distribution graph of two speech coding parameters for background noise and music, according to one embodiment of the invention.

FIG. 4 illustrates distribution graph 400 for two speech coding parameters, according to one embodiment of the invention. In this embodiment, distribution graph 400 represents a two-dimensional distribution of a first speech coding parameter $P_1$ and a second speech coding parameter $P_2$.

In one embodiment, reference numeral 410 represents an area mostly indicative of background noise. Reference numeral 420 represents an area mostly indicative of music. Reference numeral 430 represents the intersection of areas 410 and 420. Area 430 is an indeterminate area that can be handled in a manner similar to that disclosed in steps 312 to 322 of FIG. 3, for example. In one embodiment, two speech coding parameters, such as pitch correlation ($R_p$) and linear prediction coding (LPC) gain, are utilized to differentiate music from background noise.

Figure 5:
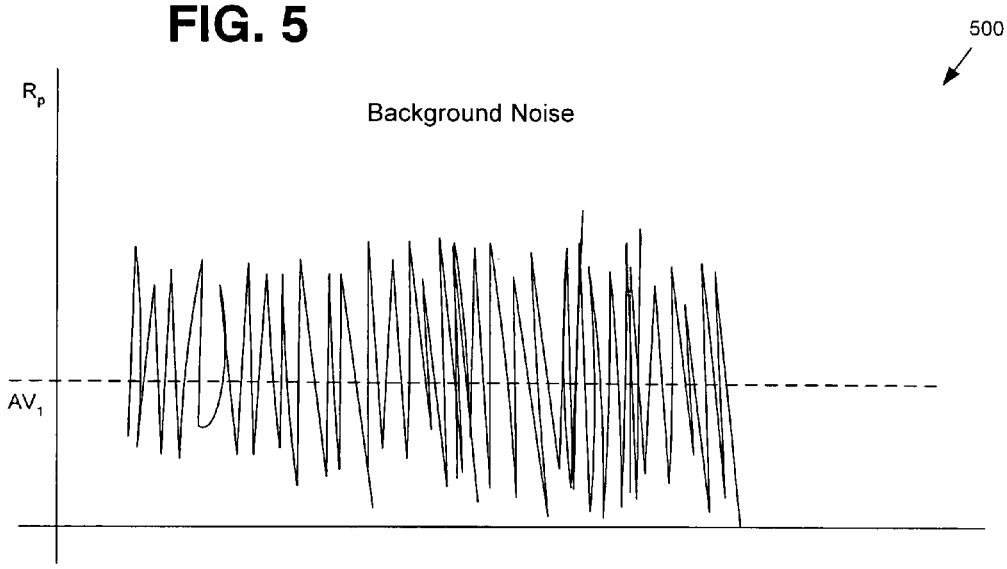
FIG. 5 illustrates an average pitch correlation for a background noise waveform, according to one embodiment of the invention.
Figure 6:
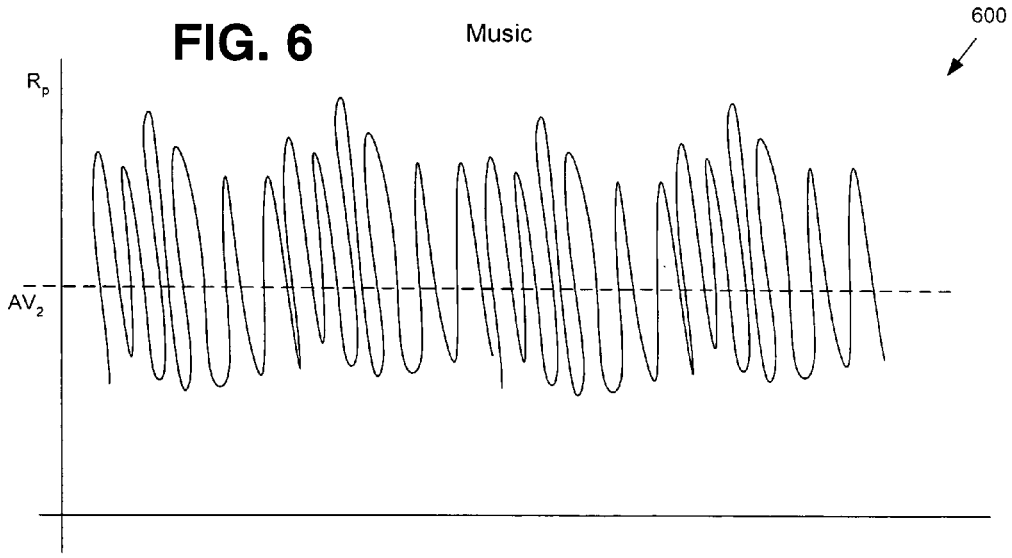
FIG. 6 illustrates an average pitch correlation for a music waveform, according to one embodiment of the invention.

Referring to FIGS. 5 and 6, as mentioned herein, noise signals are typically fairly stable relative to voice signals. The frequency spectrum of voice signals (or unvoiced signals) is rapidly in flux. On the other hand, background noise signals exhibit the same or similar frequency for a relatively long period of time, and hence there is more stability. Therefore, in conventional approaches, differentiating between voice signals and background noise signals is fairly simple and is based on signal stability. Unfortunately, music signals are also typically relatively stable for a number of frames (e.g. several hundred frames). For this reason, conventional voice activity detectors often fail to differentiate between background noise signals and music signals, and would exhibit rapidly fluctuating outputs for music signals.

FIG. 5 illustrates a background noise waveform, where the vertical axis represents $R_p$ and the horizontal axis represents time. The average value of $R_p$ for the background noise waveform is referred to as $AV_1$.

FIG. 6, on the other hand, illustrates a music waveform, where the vertical axis represents $R_p$ and the horizontal axis represents time. The average value of $R_p$ for the music waveform is referred to as $AV_2$. It is noteworthy that $AV_2$ is typically greater than $AV_1$. However, there are times when the average value of a parameter for a background noise signal is very close to the average value of a parameter for a music signal. In other words, there are times when $AV_1$ is very close to $AV_2$. As a result, it may be difficult to differentiate between background noise and music using such a speech coding parameter.

In one embodiment of the present invention, it is desirable to create more separation between $AV_1$ and $AV_2$, such that the distribution curves of FIG. 2 are further separated to cause the threshold values $T_0$, $T_1$, and $T_2$ to be sufficiently apart to make the decision making based on $P_1$ more robust. The separation between the background noise distribution and the music distribution can be increased using the stability of the music signal, thus making the distributions more distinguishable. To this end, the pitch of a previous frame is used to calculate the $R_p$ value, and as a result, $AV_1$ further drops lower, whereas $AV_2$ does not materially change. The reason for $AV_2$ not materially changing is that music spectrums typically change very slowly. This technique advantageously serves to increase the separation between the background noise distribution and the music distribution for $R_p$.

In the embodiments where the LPC gain is used as a differentiating speech coding parameter, another technique can be implemented for increasing the separation between the background noise distribution and the music distribution, as follows.

Typically, LPC gain is calculated by the following equation:

$$LPC\ \text{gain} = \prod_{i=2}^{9} (1 - K_i^2) \qquad \text{(Equation 1)}$$

where K is a refraction coefficient.

However, if $K_i$ equals 1, even for one index, the entire product equals 0. Therefore, this equation is not desirable for distinguishing between background noise and music. Therefore, in one embodiment of the present invention, $LPC_{avg}$ is calculated by the following equation:

$$LPC_{avg} = \sum_{i=2}^{9} |K_i| \qquad \text{(Equation 2)}$$

Using Equation 2, $LPC_{avg}$ is typically smaller for background noise than for music. Thus, separation between the background noise distribution and the music distribution is increased.

As mentioned herein, an Appendix is included, which comprises an example computer program listing according to one embodiment of the invention. This program listing is simply one specific implementation of one embodiment of the present invention.

Figure 7A:
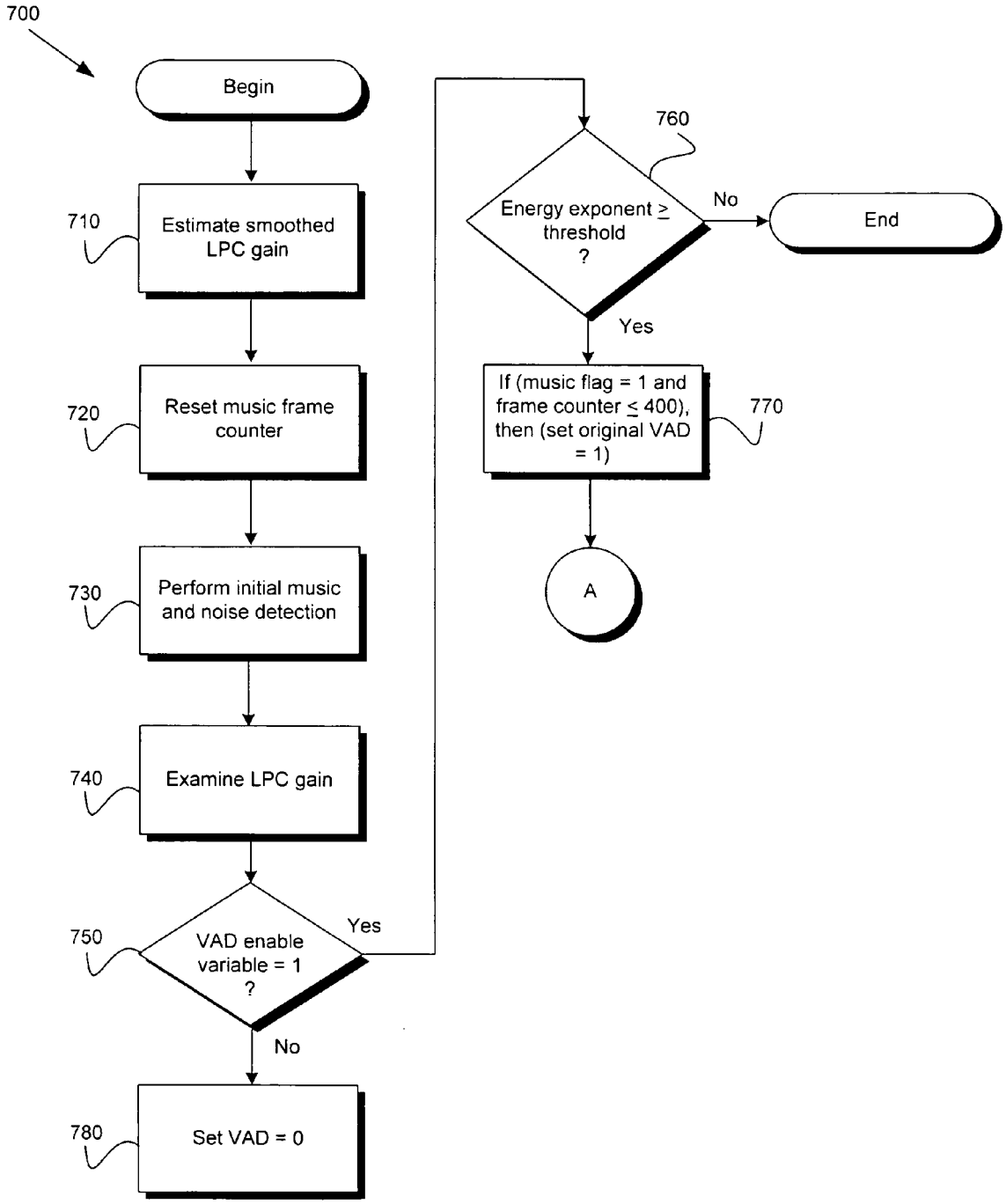
FIGS. 7A and 7B illustrates a method of differentiating background noise from music using two parameters, according to one embodiment of the invention.
Figure 7B:
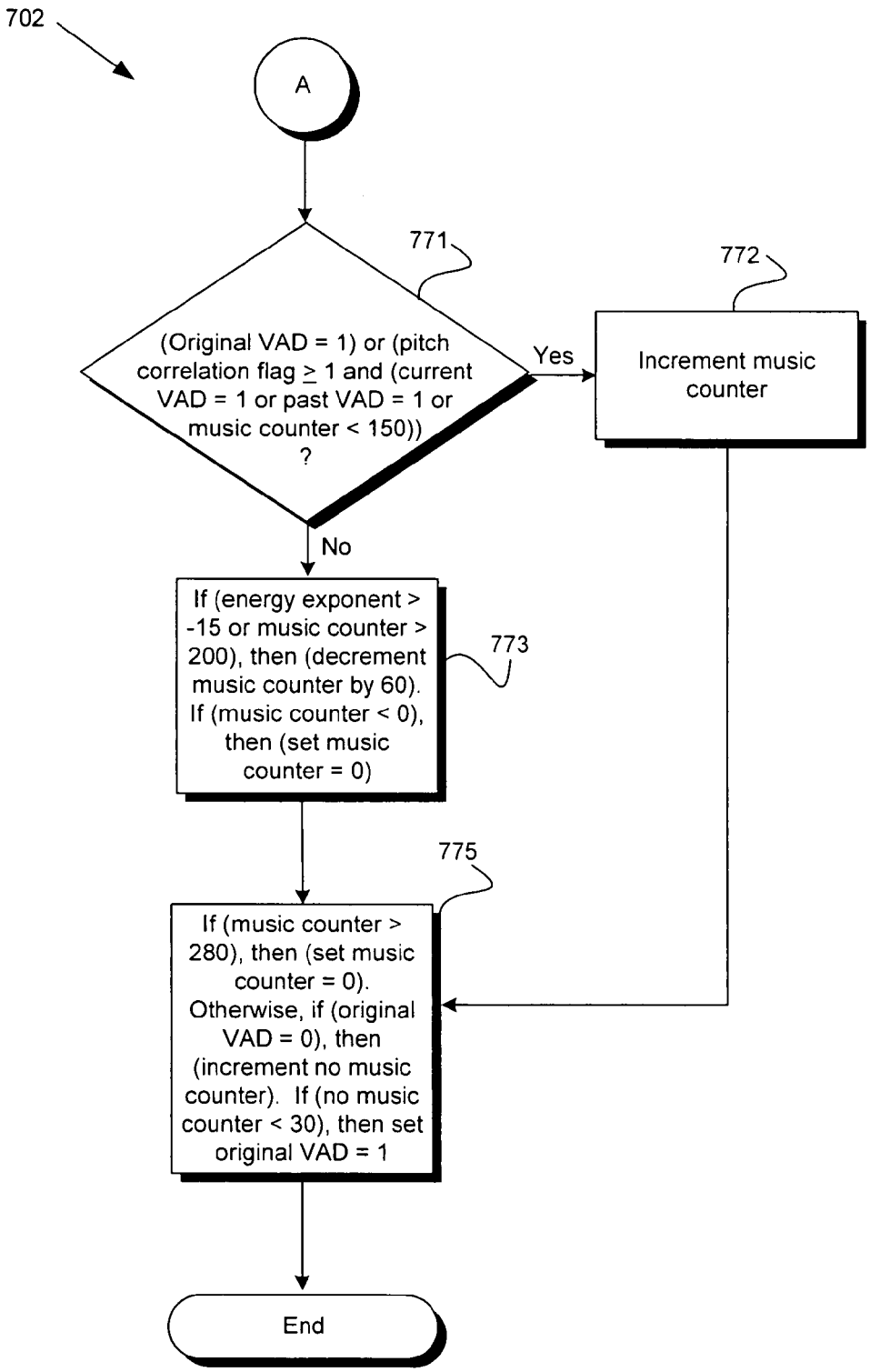

FIGS. 7A and 7B include flowcharts 700 and 702, respectively, and represent the flow of the code in the Appendix. It should be noted that certain details and features have been left out of flowcharts 700 and 702 that are apparent to a person of ordinary skill in the art. For example, a step may consist of one or more substeps or may involve specialized equipment, as is known in the art. While steps 710 through 780 indicated in flowcharts 700 and 702 are sufficient to describe one embodiment of the present invention, other embodiments of the invention may use steps different from those shown in flowcharts 700 and 702.

Referring to the attached Appendix and FIGS. 7A and 7B, Rp_flag is the pitch correlation flag and can have values of −1, 0, 1, or 2 in one embodiment. The larger the value of Rp_flag the more periodic the signal is, indicating a greater likelihood of the signal representing music. The variable rc[i] represents the reflection coefficients. It is possible for i to have an integer value from 0 to 9. The original, current, and past VAD variable values are represented by Vad, pastVad, and ppastVad, respectively. The energy exponent is represented by exp_R0. The larger the energy exponent is the higher the energy of the signal. The frame variable is a frame counter, representing the current speech frame.

At step 710, the smoothed LPC gain, refl_g_av, is estimated from the reflection coefficients of orders 2 through 9.

At step 720, the music frame counter, cnt_mus, is reset if the conditions are appropriate.

At step 730, initial music and noise detection is performed. Various calculations are performed to determine if music or noise has most likely been detected at the outset. A noise flag, nois_flag, is set equal to one indicating that noise has been detected. Alternatively, if a music flag, mus_flag, is equal to one then it is assumed that music has been detected. Step 730 is shown in greater detail in FIG. 8.

At step 740, the LPC gain is examined. If the LPC gain is high then the pitch correlation flag, Rp_flag, is modified. Specifically, if the LPC gain is greater than 4000 and the pitch correlation flag is equal to 0 then the pitch correlation flag is set equal to one, in one embodiment.

At step 750, if a VAD enable variable, vad_enable, is equal to one then the process proceeds to step 760. Otherwise the process proceeds to step 780.

At step 760, if the energy exponent is greater than or equal to a given threshold, −16 in one embodiment, then the process proceeds to step 770. Otherwise, if the energy exponent is not greater than or equal to −16, then the process ends.

At step 770, if Condition 1, Cond1, is true then the original VAD is set equal to one. That is, if the music flag is equal to one and the frame counter is less than or equal to 400, the VAD is set equal to one.

At step 771, if the original VAD is equal to one or Condition 2, Cond2, is true, then the music counter is incremented at step 772. It is noted that Condition 2 is true when the pitch correlation flag is greater than or equal to one and (the current VAD is equal to one or the past VAD is equal to one or the music counter is less than 150) then the music counter is incremented at step 772. Otherwise, the process proceeds to step 773. At step 772, if the music counter is greater than 2048 then the music counter is set equal to 2048.

At step 773, the energy exponent and the music counter are examined. If the energy exponent is greater than −15 or the music counter is greater than 200 then the music counter is decremented by 60, in one embodiment. If the music counter is less than zero then the music counter is set equal to zero.

At step 775, the music counter is examined. If the music counter is greater than 280 then the music counter is set equal to zero, in one embodiment. Otherwise, if the original VAD is equal to zero then the no music counter is incremented. At step 775, if a no music counter is less than 30, then the original VAD is set equal to one, in one embodiment. The process subsequently ends at this point.

At step 780, processing for a signal having a very low energy is performed. Specifically, if the frame counter is greater than 600 or the music counter is greater than 130 then the music frame counter is decreased by a value of four, in one embodiment. If the music frame counter is greater than 320 and the energy exponent is greater than or equal to −18 then the original VAD is set equal to one, in one embodiment. If the music frame counter is less than zero then the music counter is set equal to zero.

Figure 8:
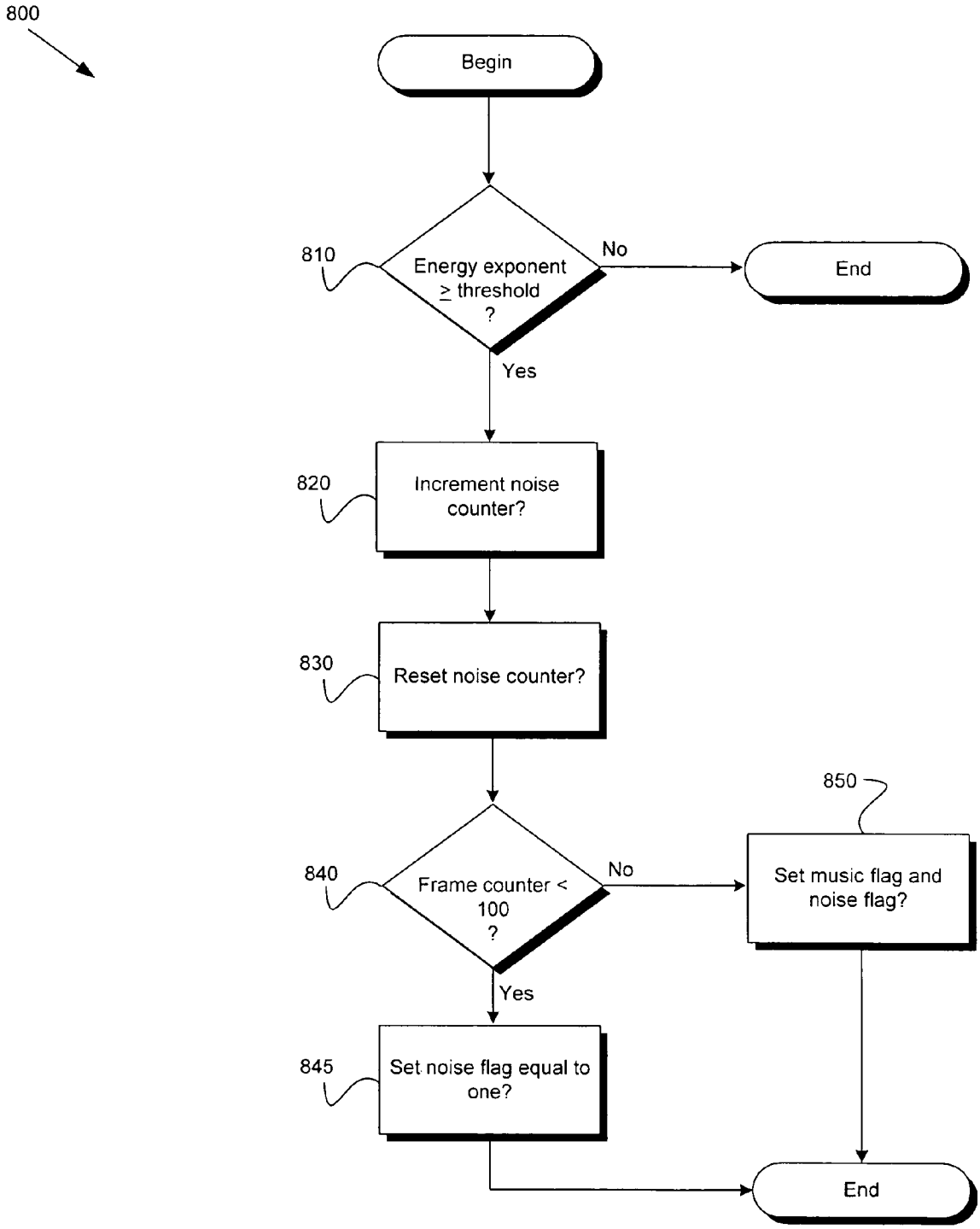
FIG. 8 illustrates a method of performing initial background noise and music detection, according to one embodiment of the invention.

Referring to FIG. 8, flowchart 800 represents an example flow of step 730 of FIG. 7A in greater detail. It should be noted that certain details and features have been left out of flowchart 800 that are apparent to a person of ordinary skill in the art. For example, a step may consist of one or more substeps or may involve specialized equipment, as is known in the art. While steps 810 through 850 indicated in flowchart 800 are sufficient to describe one embodiment of the present invention, other embodiments of the invention may use steps different from those shown in flowchart 800.

It is noted that a purpose of step 730 of FIG. 7A is to perform initial music and noise detection, as mentioned herein. Various calculations are performed to determine if music or noise has most likely been detected at the outset. A noise flag, nois_flag, is set equal to one indicating that noise has been detected. Alternatively, if a music flag, mus_flag, is equal to one then it is assumed that music has been detected. Steps analogous to the particular sequence of steps that comprise step 730 of FIG. 7A can also be used in conjunction with the beginning of the flow of FIG. 3, in one embodiment.

At step 810, if the energy exponent is greater than or equal to a given threshold, such as −16 for example, the process proceeds to step 820. Otherwise at this point step 730 of FIG. 7A ends.

At step 820, if the current value of VAD is equal to one and the pitch correlation flag is less than one, then the noise counter is incremented by a value of one minus the value of the pitch correlation flag, in one embodiment.

At step 830, in one embodiment, the noise counter is set equal to zero if a certain condition is true. The condition is whether the pitch correlation flag is equal to two, the smoothed LPC gain is greater than 8000, or the zero order reflection coefficient is greater than 0.2*32768.

At step 840, a check is made to determine if the frame counter is less than 100. If the answer is yes, the process proceeds to step 845. If the answer is no, the process proceeds to step 850.

At step 845, the noise flag is set equal to one if a certain condition is true. The condition, in one embodiment, is whether (the noise counter is greater than or equal to 10 and the frame is less than 20, or the noise counter is greater than or equal to 15) and (the zero order reflection coefficient is less than −0.3*32768 and the smoothed LPC gain is less than 6500).

At step 850, the music flag and noise flag are set under certain conditions. If the noise flag is not equal to one then the music flag is set equal to one. If the noise frame counter is less than four and the music frame counter is greater than 150 and the frame counter is less than 250 then the music flag is set equal to one and the noise flag is set equal to zero, in one embodiment. Subsequently, step 730 of FIG. 7A ends.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

Thus, a low-complexity music detection algorithm and system has been described.

APPENDIX

```
/*-----------------------------------------------------------------
    Available parameters from the coder :
    Pitch correlation flag: Rp__flag=-1,0,1,2; the larger, the more periodic.
    Reflection coefficients: rc[i], i=0,1,...,9.
    Original current and past Vad : Vad, pastVad, ppastVad.
    Energy exponent: exp__R0, the larger, the higher energy.
    Frame counter : frame
    -----------------------------------------------------------------*/
    /* Estimate smoothed LPC gain 'refl__g__av' from reflection coefficients
        of order=2 to 9. */
    L__temp=0;
    for (i=2; i<10; i++) L__temp=L__add(L__temp, (Word32)abs__s(rc[i]));
    refl__g__av = add(shr(refl__g__av, 1), (Word16)L__shr(L__temp, 4)); /*Q12*/
    /* Music frame counter 'cnt__mus' reset */
    if ( (mus__flag==0 || nois__flag==1 || nois__cnt>=100) &&
            ( (Rp__flag==-1 && frame<400) || (Rp__flag<=0 && frame<120) ) )
cnt__mus=0;
    if (cnt__nomus>=512) {
        cnt__nomus=512;
        if (Vad==0 || Rp__flag==-1 || refl__g__av<3000) cnt__mus=0;
        }
    /* Beginning music and noise detectors:
        nois__flag=1 : noise detected; mus__flag=1 : music detected */
    if (exp__R0>=-16) {
            if (pastVad==1 && Rp__flag<1) nois__cnt += 1 -Rp__flag;
        if ( (Rp__flag==2) || (refl__g__av>8000) || (rc[0]>0.3*32768) )
nois__cnt=0;
        if (frame<100) {
                if ( ( (nois__cnt>=10 && frame<20) || (nois__cnt>=15) ) &&
                    (rc[0]<-0.3*32768) && (refl__g__av<6500) ) nois__flag=1;
                }
        else {
                if (nois__flag!=1) mus__flag=1;
                if (nois__cnt<4 && cnt__mus>150 && frame<250) { mus__flag=1;
nois__flag=0; }
                }
        }
    /* If LPC gain is high, modify pitch correlation flag */
    if (refl__g__av>4000 && Rp__flag==0) Rp__flag=1;
    /* Music frame counter and music detector */
    if (vad__enable == 1) {
        if (exp__R0>=-16) {
            /* Music frame counter */
          Cond1= (mus__flag==1 && frame<=400);
          Cond2= (Rp__flag>=1) && ( (pastVad==1) || (ppastVad==1) || (cnt__mus<150)
);
          if (Cond1==1) Vad=1;
          if ( (Cond2==1) || (Vad==1) )
              {
              cnt__mus++;
              if (cnt__mus>2048) cnt__mus=2048;
              }
          else
              {
                  if (exp__R0>=-15 || cnt__mus>200) cnt__mus = sub(cnt__mus, 60);
              if (cnt__mus<0) cnt__mus=0;
              }
          /* Music detector */
          if (cnt__mus>280) cnt__nomus=0;
          else if (Vad==0) cnt__nomus++;
          if (cnt__nomus<30) Vad=1;
          }
        else {
            /* For very low energy signal */
            if (frame>600 || cnt__mus>130) cnt__mus = sub(cnt__mus, 4);
            if (cnt__mus>320 && exp__R0>=-18) Vad=1;
          if (cnt__mus<0) cnt__mus=0;
          }
        }
```

The invention claimed is:

1. A method for detecting music in a speech signal having a plurality of frames, said method comprising:

defining a music threshold value for a first parameter extracted from a frame of said speech signal;

defining a background noise threshold value for said first parameter;

defining an unsure threshold value for said first parameter, wherein said unsure threshold value falls between said music threshold value and said background noise threshold value;

wherein if said first parameter does not fall between said music threshold value and said background noise threshold value, classifying said speech signal as music if said first parameter is in closer range of said music threshold value than said unsure threshold value; and classifying said speech signal as background noise if said first parameter is in closer range of said background noise threshold value than said unsure threshold value;

wherein if said first parameter falls between said music threshold value and said background noise threshold value, classifying said speech signal as music or background noise based on analyzing a plurality of first parameters extracted from said plurality of frames.

2. The method of claim 1, said method further comprising if a value of said first parameter falls between said unsure threshold value and said background noise threshold value, then incrementing a no music frame counter.

3. The method of claim 1, said method further comprising if a value of said first parameter falls between said unsure threshold value and said music threshold value, then incrementing a music frame counter.

4. The method of claim 1, said method further comprising comparing a no music frame counter and a music frame counter after analyzing a plurality of values of said first parameter falling between said background noise threshold value and said music threshold value.

5. The method of claim 4, said method further comprising setting a VAD variable equal to a first value if said no music frame counter is greater than said music frame counter.

6. The method of claim 4, said method further comprising setting a VAD variable equal to a second value if said no music frame counter is less than said music frame counter.

7. The method of claim 4, said method further comprising setting a VAD variable equal to a third value if said no music frame counter is within a predetermined threshold value of said music frame counter.

8. The method of claim 1, wherein said first parameter is related to LPC gain.

9. The method of claim 1, said method further comprising analyzing a plurality of values of a second parameter.

10. The method of claim 9, wherein said second parameter is related to a reflection coefficient.

11. The method of claim 1, said method further comprising performing initial music and background noise detection.

12. The method of claim 1, said method further comprising using a pre-existing parameter to perform music detection.

13. A system for detecting music in a speech signal having a plurality of frames, said system comprising:

a module for defining a music threshold value for a first parameter extracted from a frame of said speech signal;

a module for defining a background noise threshold value for said first parameter;

a module for defining an unsure threshold value for said first parameter, wherein said unsure threshold value falls between said music threshold value and said background noise threshold value;

a module for classifying said speech signal as music if said first parameter is in closer range of said music threshold value than said unsure threshold value, if said first parameter does not fall between said music threshold value and said background noise threshold value;

a module for classifying said speech signal as background noise if said first parameter is in closer range of said background noise threshold value than said unsure threshold value, if said first parameter does not fall between said music threshold value and said background noise threshold value;

a module for classifying said speech signal as music or background noise based on analyzing a plurality of first parameters extracted from said plurality of frames, if said first parameter falls between said music threshold value and said background noise threshold value.

14. The system of claim 13, said system further comprising a module for incrementing a no music frame counter if a value of said first parameter falls between said unsure threshold value and said background noise threshold value.

15. The system of claim 13, said system further comprising a module for incrementing a music frame counter if a value of said first parameter falls between said unsure threshold value and said music threshold value.

16. The system of claim 13, said system further comprising a module for comparing a no music frame counter and a music frame counter after analyzing a plurality of values of said first parameter falling between said background noise threshold value and said music threshold value.

17. The system of claim 16, said system further comprising a module for setting a VAD variable equal to a first value if said no music frame counter is greater than said music frame counter.

18. The system of claim 16, said system further comprising a module for setting a VAD variable equal to a second value if said no music frame counter is less than said music frame counter.

19. The system of claim 16, said system further comprising a module for setting a VAD variable equal to a third value if said no music frame counter is within a predetermined threshold value of said music frame counter.

20. The system of claim 13, wherein said first parameter is related to LPC gain.

21. The system of claim 13, said system further comprising a module for analyzing a plurality of values of a second parameter.

22. The system of claim 21, wherein said second parameter is related to a reflection coefficient.

23. The system of claim 13, said system further comprising a module for performing initial music and background noise detection.

24. The system of claim 13, said system further comprising a module for using a pre-existing parameter to perform music detection.

25. A computer readable medium including computer software program executable by a processor for implementing a method of detecting music in a speech signal having a plurality of frames, said computer software program comprising:

code for defining a music threshold value for a first parameter extracted from a frame of said speech signal;

code for defining a background noise threshold value for said first parameter;

code for defining an unsure threshold value for said first parameter, wherein said unsure threshold value falls between said music threshold value and said background noise threshold value;

code for classifying said speech signal as music if said first parameter is in closer range of said music threshold value than said unsure threshold value, if said first parameter does not fall between said music threshold value and said background noise threshold value;

code for classifying said speech signal as background noise if said first parameter is in closer range of said background noise threshold value than said unsure threshold value, if said first parameter does not fall between said music threshold value and said background noise threshold value;

code for classifying said speech signal as music or background noise based on analyzing a plurality of first parameters extracted from said plurality of frames, if said first parameter falls between said music threshold value and said background noise threshold value.

26. The computer software program of claim 25, said computer software program further comprising code for incrementing a no music frame counter if a value of said first parameter falls between said unsure threshold value and said background noise threshold value.

27. The computer software program of claim 25, said computer software program further comprising code for incrementing a music frame counter if a value of said first parameter falls between said unsure threshold value and said music threshold value.

28. The computer software program of claim 25, said computer software program further comprising code for comparing a no music frame counter and a music frame counter after analyzing a plurality of values of said first parameter falling between said background noise threshold value and said music threshold value.

29. The computer software program of claim 28, said computer software program further comprising code for setting a VAD variable equal to a first value if said no music frame counter is greater than said music frame counter.

30. The computer software program of claim 28, said computer software program further comprising code for setting a VAD variable equal to a second value if said no music frame counter is less than said music frame counter.

31. The computer software program of claim 28, said computer software program further comprising code for setting a VAD variable equal to a third value if said no music frame counter is within a predetermined threshold value of said music frame counter.

32. The computer software program of claim 25, wherein said first parameter is related to LPC gain.

33. The computer software program of claim 25, said computer software program further comprising code for analyzing a plurality of values of a second parameter.

34. The computer software program of claim 33, wherein said second parameter is related to a reflection coefficient.

35. The computer software program of claim 25, said computer software program further comprising code for performing initial music and background noise detection.

36. The computer software program of claim 25, said computer software program further comprising code for using a pre-existing parameter to perform music detection.

* * * * *